United States Patent [19]

Matsushita et al.

[11] 4,367,430

[45] Jan. 4, 1983

[54] SHADOW MASK TYPE COLOR CATHODE-RAY TUBE

[75] Inventors: Mitsuru Matsushita; Koji Nakamura, both of Nagaokakyo, Japan

[73] Assignee: Mitsubishi Denki Kabushiki Kaisha, Tokyo, Japan

[21] Appl. No.: 114,399

[22] Filed: Jan. 23, 1980

[30] Foreign Application Priority Data

Jan. 25, 1979 [JP] Japan ..... 54-8343[U]
May 17, 1979 [JP] Japan ..... 54-61050

[51] Int. Cl.[3] ..... H01J 29/80
[52] U.S. Cl. ..... 313/405; 313/402
[58] Field of Search ..... 313/402, 403, 404, 405

[56] References Cited

U.S. PATENT DOCUMENTS 3,581,135 5/1971 Garrett ..... 313/402
3,660,708 4/1972 Nakamura et al. ..... 313/405
3,754,157 8/1973 Yamazaki et al. ..... 313/405
3,855,493 12/1974 Snook et al. ..... 313/402
3,912,963 10/1975 Sedivy ..... 313/402
3,935,036 1/1976 Kinsch ..... 313/402
4,056,755 11/1977 Sohn ..... 313/402

*Primary Examiner*—Eli Lieberman
*Attorney, Agent, or Firm*—Oblon, Fisher, Spivak, McClelland & Maier

[57] ABSTRACT

A shadow mask type color cathode-ray tube has support springs and a shadow mask. The shadow mask has an aperture comprising a spherical part having many electron beam through-holes; a skirt part being substantially perpendicular to the spherical part; and a flange part extended from the skirt part to substantially parallel to the spherical part in one piece. The thickness of the skirt part and the flange part are thicker than that of the part having the electron beam through-holes. The shadow mask is supported by the support spring to absorb a shock or to decrease an amplitude in a resonance.

8 Claims, 18 Drawing Figures

FIG. 8(a)
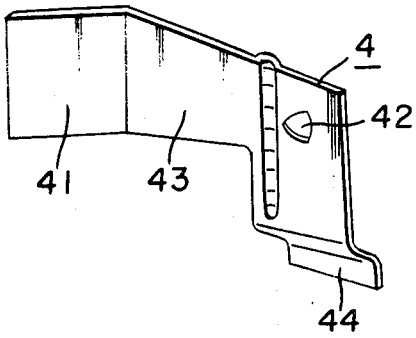
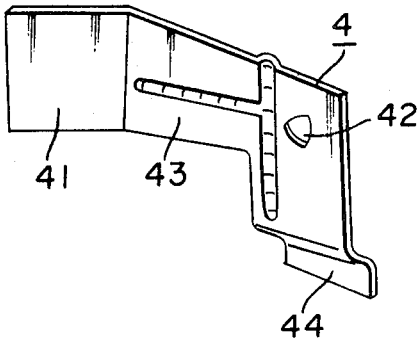
FIG. 8(b)
FIG. 9
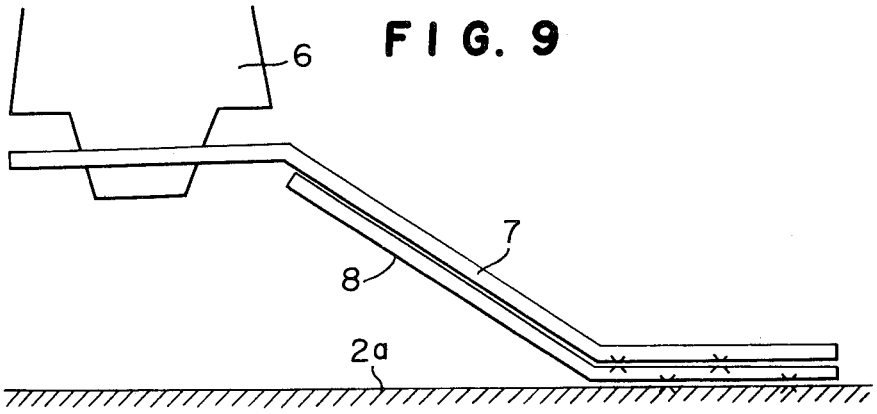

SHADOW MASK TYPE COLOR CATHODE-RAY TUBE

BACKGROUND OF THE INVENTION

1. Field of the Invention

The present invention relates to a shadow mask type color cathode-ray tube having a light weight and an improved shock resistant characteristic.

2. Description of the Prior Art

The shadow mask is used as chrominance selective electrode of a color cathode-ray tube. The structure of the shadow mask is classified to the structures shown in FIGS. 1 and 2. In the structure of FIG. 1, it comprises an aperture (2) having many through-holes on a spherical part and basical functions as the shadow mask (1); a frame (3) for reinforcing the aperture (2); and a spring (4) for fitting the shadow mask (1) on the inner peripheral part of the color cathode-ray tube. In the structure of the shadow mask (1) shown in FIG. 1, a frame (3) having high strength is required for reinforcing the aperture (2) and accordingly, it is usually formed with an iron plate having a thickness of 1.2 to 2 mm. Thus, the weight of the shadow mask is too large. When the shadow mask is supported by springs (4) having enough strength to resist certain shock applied to the color cathode-ray tube, it is disadvantageously difficult to operate the repeat fittings and detachings of the shadow mask (1) for several times which are required for the preparation of the color cathode-ray tube. Accordingly, a light weight shadow mask has been proposed and used. The structure of the shadow mask shown in FIG. 2 has been used for a small color cathode-ray tube having a diameter of less than 6". In FIG. 2, the same reference numerals designate the parts having the same function shown in FIG. 1. In the structure of FIG. 2, a flange part (2*b*) extended to be substantially parallel to the spherical part from the skirt part (2*a*) is formed to reinforce the aperture (2) itself and the frame (3) has a configuration of a window frame made of an iron or stainless steel plate and is fixed to the flange part (2*b*) of the aperture. The weight of the shadow mask (1) can be $\frac{1}{2}$ to $\frac{1}{3}$ of the weight of the shadow mask shown in FIG. 1 as a cathode-ray tube having a diameter of 6". The shadow mask having such structure has not enough strength of the aperture itself. The following disadvantages are found.

It is necessary to form regular electron beam throughholes on the spherical part of the aperture (2) (diameter of 0.10 to 0.25 mm in the case of round through-holes width of 0.13 to 0.20 mm in the case of rectangular through-holes) in high accuracy. The through-holes are formed by a photoetching method. It is difficult to form through-holes having a diameter less than a thickness of the spherical part. In both of round through-holes and rectangular through-holes, a diameter of through-holes at peripheral part is usually smaller than that of the central part, and a thickness of the aperture is usually less than 0.18 mm. Therefore, the strength of the skirt part (2*a*) is not enough high. When the support spring (4) is bent in the fitting and detaching operations of the shadow mask (1), the total weight is locally applied to the skirt part (2*a*) to cause a deformation of the skirt part (2*a*). The strain is applied to the spherical part to cause inferior characteristics as the shadow mask. When the frame (3) is fixed to the flange part (2*b*) of the aperture, it is usual to weld them by a plurality of spot weldings. The strain is remained after the welding because of unstable strength of the aperture (2) itself. The satisfactory function of the shadow mask is not give. Moreover, in the conventional color cathode-ray tube, certain shock is applied through the support spring (4) to the shadow mask (1). The color fringing on the color cathode-ray tube is caused by the shock.

SUMMARY OF THE INVENTION

It is an object of the present invention to provide a shadow mask color cathode-ray tube having light weight and enough strength to resist to shock.

The foregoing and other objects of the present invention have been attained by providing a shadow mask type color cathode-ray tube which has support springs and a shadow mask comprising an aperture having a spherical part having a plurality of electron beam through-holes; a skirt part being substantially perpendicular to the spherical part; and a flange part extended from the skirt part in substantially parallel to the spherical part in one piece wherein thicknesses of the skirt part and the flange part of the aperture are thicker than the thickness of the electron beam through-holes part.

BRIEF DESCRIPTION OF THE DRAWINGS

FIGS. 8(*a*), (*b*) are respectively schematic views of one embodiment of a support spring used in a shadow mask type color cathode-ray tube of the present invention;

FIG. 9 is a side view of the other embodiment of a support spring;

DETAILED DESCRIPTION OF THE PREFERRED EMBODIMENTS

Figure 3:
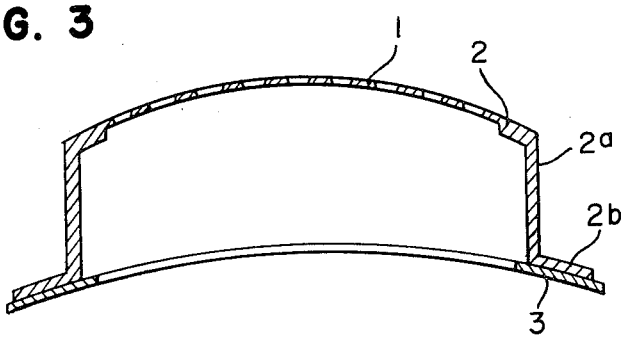
FIG. 3 is a sectional view of one embodiment of a shadow mask used in the present invention.

Referring to FIG. 3, one embodiment of a shadow mask of a shadow mask type color cathode-ray tube of the present invention will be illustrated.

Figure 1:
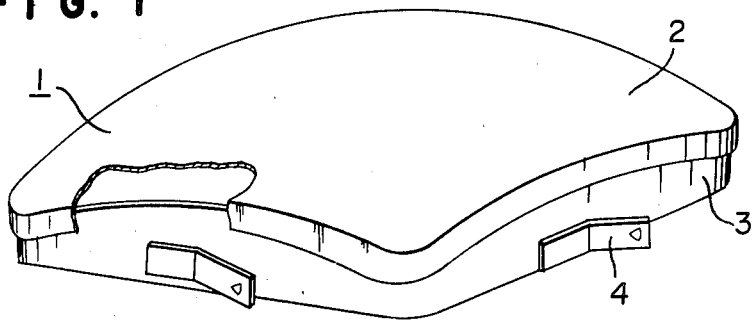
FIGS. 1 and 2 are respectively partially broken schematic views of one embodiment of a conventional shadow mask.
Figure 2:
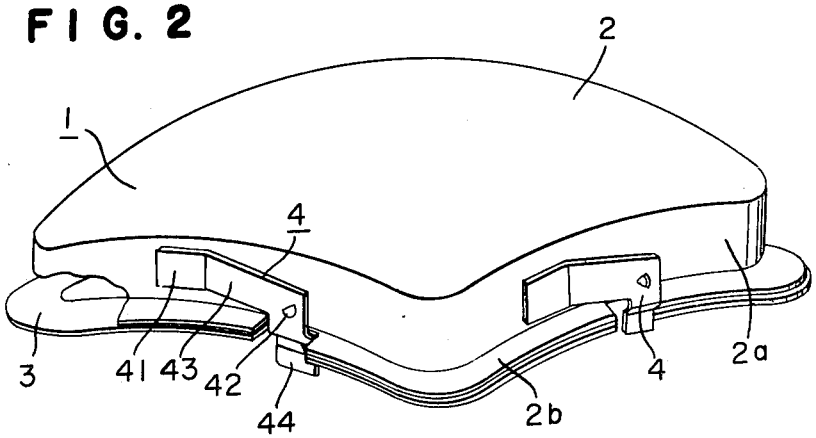

FIG. 3 is a sectional view of the shadow mask wherein the same reference numerals designate the parts having the same function as those of FIG. 2. Only aperture (2) is different from the structure of the shadow mask shown in FIG. 2. The spherical part of the aperture (2) has a thickness depending upon a diameter of the through-holes such as 0.10 to 0.18 mm, but a skirt part (2*a*) and a flange part (2*b*) have thicker thickness such as 0.2 to 0.3 mm and are formed in one piece. It is not so difficult to form such aperture (2). As described, in an initial step of forming the aperture (2), electron beam through-holes are perforated on a flat iron plate by a photoetching method. Before the initial step the thickness of the plate at the electron beam through-holes is processed by a photoetching method to be thinner and then is perforated to form the electron beam through-holes whereby the through-holes can be perforated in high accuracy and the part of the aperture (2) having no through-holes has a thicker thickness. In the shadow mask (1), a strength of such aperture (2) is two or three times of the strength of the conventional structure. Moreover, strengths of the skirt part, the aperture flange part are higher whereby shock resistant characteristics can be improved.

Figure 4:
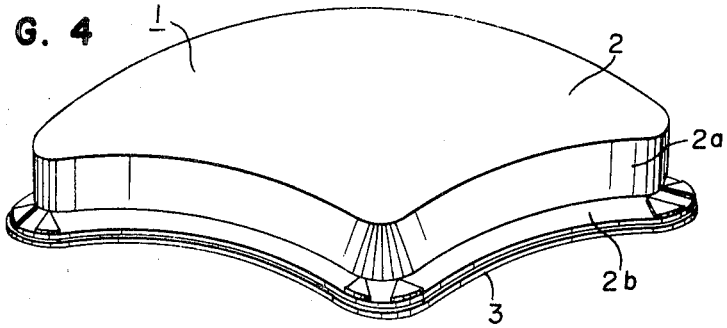
FIG. 4 is a schematic view of the other embodiment of a shadow mask used in the present invention.

FIG. 4 shows the other embodiment of reinforcing means. At each corner of the skirt part (2*a*) of the aperture (2), a corrugation having a height of more than two times of a thickness of the plate at the skirt part (2*a*), is formed. The flange part (2*b*) at each corner can be reinforced by forming plied substrates. Such aperture (2) can be easily prepared by using a special mold in a press-molding.

The aperture (2) of the shadow mask having such structure, at each corner, has a strength of more than two times of the strength of the conventional one shown in FIG. 2 whereby the problem of the strength of the aperture can be overcome and a deformation caused by welding a frame (3) can be decreased. Accordingly, a shadow mask having light weight and excellent shock resistant characteristic can be obtained even though the size is larger than 8".

Figure 5:
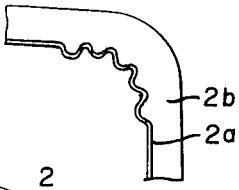
FIG. 5 is a plane view of a part of an edge of the embodiment shown in FIG. 4.

As shown in FIG. 5, it is preferable to form each corrugation having a thickness of more than 2 times of a thickness of the plate at each corner of the skirt part.

The relation of the shadow mask (1) and the support spring (4) will be described.

As shown in FIG. 2, one end of the support spring (4) is fixed on the skirt part (2*a*) of the aperture by an electric resistance welding method etc. When the support spring (4) is bent in the repeat fitting and detaching operation of the shadow mask (1), a weight being higher than the shadow mask support pressure is applied. Thus, the total weight is applied to the fixed part of the support spring (4) on the skirt part (2*a*) whereby the skirt part (2*a*) is deformed. The strain is applied to the spherical part to cause inferior characteristics of the shadow mask. This trouble may be eliminated by an increase of a thickness of the plate of the aperture (2) so as to increase the strength of the aperture (2). However, on the spherical part, it is necessary to form regular electron beam through-holes in high accuracy. Therefore, the holes are formed by a photoetching method etc. and accordingly, a thickness of the plate should be thin such as less than 0.18 mm.

Figure 6A:
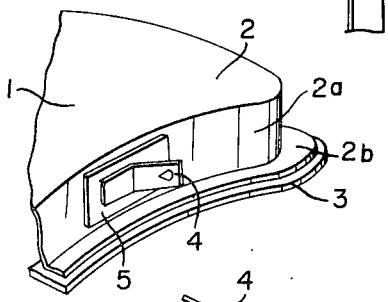
FIG. 6 shows a structure of a part of the conventional shadow mask near a supporting plate wherein (a) is a schematic view; and (*b*) is a side view.
Figure 6B:
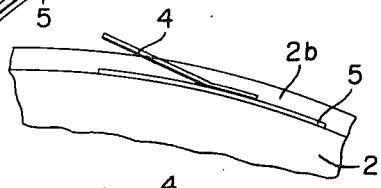
Figure 7B:
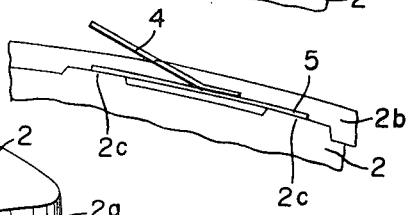
FIG. 7 shows a structure of a part of the shadow mask used in the present invention wherein (*a*) is a schematic view; (*b*) is a side view; and (*c*) is a schematic view of the other support plate.
Figure 7A:
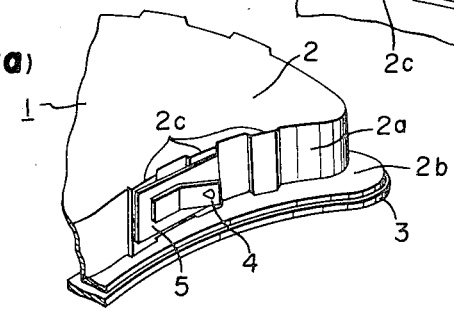

It has been proposed to distribute the weight applied through the support spring by providing a support plate (5) under the support spring (4) as shown in FIGS. 6(*a*), (*b*). Thus, the skirt part (2*a*) has usually certain curvature because of a moldability and structure characteristics. A strain is caused in the skirt part (2*a*) by the fixing of the support plate (5) on the skirt part if the support plate (5) has not the same curvature as that of the skirt part (2*a*). Even though the support plate (5) has such curvature, the fixing part of the support spring should have the same curvature. Therefore, the configurations of the parts are so complicated that a light weight structure is not attained and the shock resistant characteristic is inferior. Thus, the support spring is fixed on the shadow mask (1) as shown in FIGS. 7 (*a*), (*b*) wherein a plurality of projections (2*c*) are formed on the skirt part (2*a*) of the aperture (2) and the support plate (5) is fixed on the projections (2*c*) as a form of bridge, and the support spring (4) is fixed at about center of the support plate (5). In such structuıe, even though the fixed parts of the support plate (5) and the support spring (4) are flat, there is not trouble of strain applied to the aperture by the curvature of the skirt part because the support plate (5) is fixed on the projections fo the skirt part (2*a*). Moreover, the skirt part (2*a*) of the aperture (2) is reinforced by the projections (2*c*) on the skirt part (2*a*). Therefore, the trouble is not caused even though the effect for the distribution of the weight of the support spring (4) is lower than that of the structure shown in FIG. 5.

FIGS. 8(*a*), (*b*) show one embodiment of the support spring (4) of the shadow mask which is different from the conventional support spring by forming a reinforcing bead on the effective spring part (43). In FIG. 8(*a*), the reinforcing bead is formed in vertical to the longitudinal direction. In FIG. 8(*b*), the reinforcing bead is formed in the longitudinal direction.

In accordance with such structure, the support spring is durable to twist and has high mechanical strength against vibration and shock etc.

In the embodiment, a concaved groove is formed as the reinforcing bead of the plate spring. Thus, the same effect can be attained by fixing the other reinforcing substrate such as a piano wire by a welding etc.

FIG. 9 is a partially enlarged view of a shadow mask support part which corresponds to one of the support pin (6) for the shadow mask. The plate spring (7) having a configuration in the form of parallel parts separated and integrally connected by means of a slanted part fitted to the support pin (6) and a plate spring (8) having a configuration form of a slanted part integrally connected to a flat part and having the same thickness is plied at the plate spring slant part and the shadow mask side part to form the plied plate spring and both of the plate springs at the shadow mask side parts are welded on the skirt part (2*a*) of the shadow mask.

A part of vibration energy caused by certain shock can be absorbed by the plate springs (7), (8) between the support pin (6) and the shadow mask (1) in said structure. In a test of a color cathode-ray tube having 14" and 90 degree, an average maximum value of vibration of the conventional shadow mask (1) having four corners shown in FIG. 2 is resonance is 308 μm whereas that of the shadow mask supported by three plied plate springs shown in FIG. 9 is only 228 μm.

In said structure, a bimetal piece for calibration of thermal expansion can be placed between the plate spring and the frame. As described, in this embodiment, the shadow mask is supported on the support pins of the panel part by plied plate springs; a shock is absorbed well by the plied plate springs to decrease the amplitude of vibration of the shadow mask at the resonance and accordingly, a color fringing of a color cathode-ray tube can be decreased.

Figure 10A:
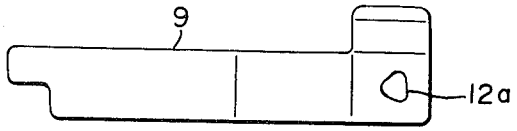
FIGS. 10(*a*), (*b*), (*c*) are respectively front views of embodiments of the support spring.
Figure 10B:
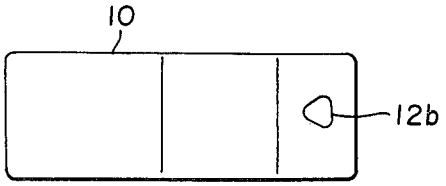
Figure 10C:
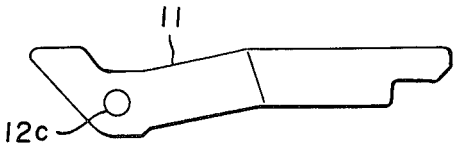

FIGS. 10(*a*), (*b*), (*c*) show the other embodiments as three configurations of plate springs (9), (10), (11). The reference numerals (12*a*), (12*b*), (12*c*) respectively designate holes for connecting a support pin (6). The plate springs (9), (10), (11) respectively have different configurations and different thicknesses. For example, a thickness of the plate spring (9) or (11) is 0.75 mm and a thickness of the plate spring (10) is 1.00 mm. The natural vibration constants of the plate springs (9), (10), (11) are respectively depending upon each width and each thickness of each plate spring regardless of each configuration of a side of each plate spring. Therefore, they are not shown in the drawing. The hole (12*c*) for fitting the plate spring (11) has the different configuration from those of the holes (12*a*), (12*b*). The natural vibration constants of the plate springs can be slightly changed by different configurations of the holes (12*c*).

When the plate springs (9), (10), (11) having different spring constants such as different natural vibration constants are used, the resonance points are different even though certain vibration is applied, the peak of the vibration is applied, the peak of the vibration of the shadow mask at the resonance point can be decreased.

When the conventional springs (4) are used in a color cathode-ray tube having a diameter of 14", an average vibration amplitude of the shadow mask (6) corresponding to the four corners of the screen is 308 μm and the maximum vibration amplitude is about 245 μm. This is remarkable decreased.

Figure 11:
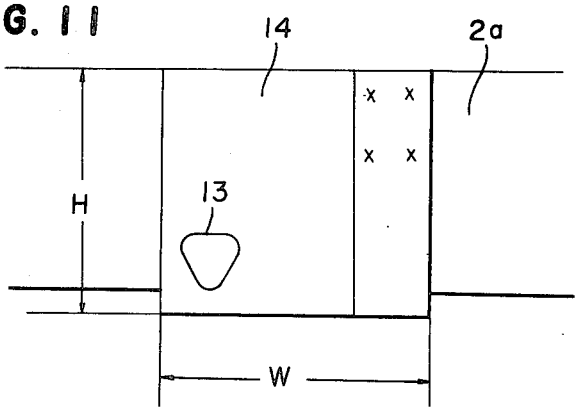
FIGS. 11 and 12 are respectively front views of the other embodiments of the support spring.
Figure 12:
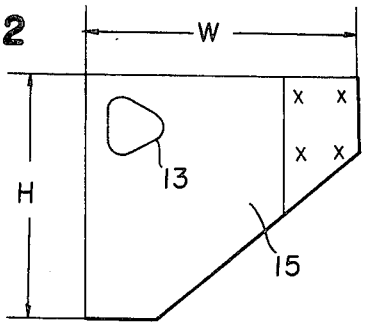

FIG. 11 is a plane view of the other embodiment of the support spring; and FIG. 12 is a plane view of the other embodiment of the support spring wherein the reference numeral (13) designates a hole for fitting a panel pin (6) a plate spring (14) or (15) and the reference X designates a place for welding the plate spring (14) or (15) to the skirt part (2*a*); the reference W designates a size of the plate spring (14) or (15) in the width direction; the reference H designates a size of the plate spring (14) or (15) in the longitudinal direction. The stiffness of the plate spring (14), (15) is depending upon a distance between the hole (13) for fitting by the panel pin (6) to the welded point of the skirt part (2*a*); the size H, the size W, the thickness of the plate spring (14) or (15) and the material for the spring.

In comparison with the conventional plate spring, when the material and the thickness of the plate spring are the same, the characteristics of the plate spring (8) are decided depending upon the size H and the size W. In this embodiment, the size H is remarkably larger than that of the conventional plate spring, whereby a twist caused in the other embodiment is not found. Therefore, the deviation of the shadow mask in the tube axial direction can be prevented by using the plate spring of this embodiment. As the optimum embodiment, the twist component in the Z axis is decreased by providing $H \approx W$.

FIG. 11 shows the embodiment having rectangular plane configuration of the plate spring (14). FIG. 12 shows the embodiment having triangular plane configuration of the plate spring (15). Both of them are effective for preventing the twist in the tube axial direction.

In accordance with this embodiment, the plate spring has high strength in the twist direction, the amplitude of the shadow mask by a resonance is lower to decrease the color fringing.

As described, in accordance with the shadow mask color cathode-ray tube of the present invention, it has light weight and can absorb shock by plate springs to decrease an amplitude of the vibration of the shadow mask and a color cathode-ray tube having excellent shock resistance can be obtained.

We claim:

1. A shadow mask color cathode-ray tube comprising:
   - a shadow mask having an aperture and supported by support springs, said shadow mask comprising;
   - a spherical part having plural electron beam through holes;
   - a skirt part integrally connected to said spherical part substantially perpendicular thereto;
   - a flange part integrally connected to said skirt part and extending therefrom substantially parallel to said spherical part;
   - wherein said skirt part has a corrugation at each of the corners of said mask, said corrugation having a trough to crest distance at least two times the thickness of said skirt part and wherein said corrugation extends substantially the entire extent of said skirt part at each of said corners;
   - wherein said spherical part has a thickness from 0.10 to 0.18 mm and said skirt part and said flange part have a thickness from 0.2 to 0.3 mm.

2. A shadow mask type color cathode-ray tube according to claim 1, wherein said flange part has a corrugation having a thickness of at least 2 times the thickness of said skirt part.

3. A shadow mask type color cathode-ray tube according to claim 1, comprising:
   - a plurality of projections formed on said skirt part, and
   - at least one support spring bridged on at least two of said projections.

4. A shadow mask type color cathode-ray tube according to claim 3, wherein said support spring comprises:
   - a plate spring having a center part serving as an effective spring part, said plate spring having a reinforcing bead provided on the center part of said plate spring.

5. A shadow mask type color cathode-ray tube according to claim 3, comprising:
   - plural of said support springs provided in the form of at least three plate springs having different natural vibration constants.

6. A shadow mask type color cathode-ray tube according to claim 3, wherein said at least one support spring comprises:
   - a plied plate spring prepared by plying at least two plate springs.

7. A shadow mask type color cathode-ray tube according to claim 3, wherein said support spring comprises:
   - a plate spring having a rectangular plane configuration.

8. A shadow mask type color cathode-ray tube according to claim 3, wherein said support spring comprises:
   - a plate spring having a triangular plane configuration.

* * * * *